US007284685B1

(12) United States Patent
Wojcicki

(10) Patent No.: US 7,284,685 B1
(45) Date of Patent: Oct. 23, 2007

(54) PUSHER BEARING AND PUSHER BLOCK FOR MAGAZINE FEEDER

(75) Inventor: Andrzej R. Wojcicki, Rosedale, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/493,995

(22) Filed: Jul. 27, 2006

(51) Int. Cl.
*B25C 1/04* (2006.01)
*B27F 7/13* (2006.01)

(52) U.S. Cl. ..... 227/119; 227/120; 227/136

(58) Field of Classification Search ..... 227/119, 227/120, 8, 136, 148
See application file for complete search history.

(56) References Cited

U.S. PATENT DOCUMENTS 5,240,161 A * 8/1993 Kaneko ..... 227/109
5,322,189 A * 6/1994 Oda ..... 221/227
6,264,085 B1 * 7/2001 Ho et al. ..... 227/8
6,290,115 B1 * 9/2001 Chen ..... 227/120
6,431,428 B1 * 8/2002 Chen ..... 227/120
6,609,646 B2 8/2003 Miller et al.
6,655,572 B2 * 12/2003 Amada ..... 227/109
6,679,413 B2 1/2004 Miller et al.
6,685,078 B2 * 2/2004 Wohlwend et al. ..... 227/120
6,729,524 B1 * 5/2004 Yao ..... 227/120
6,772,931 B2 8/2004 Miller et al.
6,938,809 B1 * 9/2005 Schnell ..... 227/8
6,938,812 B2 9/2005 Miller et al.
7,025,242 B1 * 4/2006 Schnell ..... 227/120
7,028,875 B1 * 4/2006 Beville et al. ..... 227/8
7,150,385 B1 * 12/2006 Wen ..... 227/8
2005/0092806 A1 5/2005 Miller et al.
2005/0218175 A1 10/2005 Schell et al.

OTHER PUBLICATIONS

Parts List for D51431 Type 1, www.dewaltservicenet.com; Copyright 2005; pp. 1-5.

* cited by examiner

*Primary Examiner*—Scott A. Smith
(74) *Attorney, Agent, or Firm*—Harness, Dickey & Pierce, P.L.C.

(57) ABSTRACT

A magazine for a fastening tool that drives one or more fasteners into a workpiece includes an outer case and an inner rail movable relative to the outer case. The inner rail is extendable from the outer case so as to permit adding of the one or more fasteners to the magazine. A bar extends between a front end and a rear end of the inner rail. A pusher bearing slidably receives the bar. A spring biases the pusher bearing toward the front end. A pusher block is coupled to the pusher bearing. The pusher block is moveable along the inner rail and is operable to urge the one or more fasteners toward the front end. The pusher block is moveable about the pusher bearing.

9 Claims, 7 Drawing Sheets

PUSHER BEARING AND PUSHER BLOCK FOR MAGAZINE FEEDER

FIELD

The present teachings relate to a fastening tool and more specifically relate to a pusher bearing and a pusher block in a magazine of the fastening tool that more uniformly distributes force on one or more fasteners in the magazine.

BACKGROUND

A number of pneumatically and electrically operated tools have been developed to drive fasteners, such as staples and nails, into workpieces. Typically, these tools employ a magazine for holding a plurality of the fasteners and feeding the fasteners into a nose of the tool prior to driving the fasteners into the workpiece.

Despite the widespread use of such tools, it is known that fasteners being fed through the magazine and into a driver blade channel formed in the nosepiece of the fastening tool can jam. In this regard, stack-up tolerances of all of the components of the magazine, plus imperfections in the fasteners, can contribute to the fasteners jamming in the magazine. While jammed fasteners can be readily evacuated from the magazine and the nose, there remains room in the art for improvement.

SUMMARY

The various aspects of the present teachings generally include a magazine for a fastening tool that drives one or more fasteners into a workpiece. The magazine includes an outer case and an inner rail movable relative to the outer case. The inner rail is extendable from the outer case so as to permit adding of the one or more fasteners to the magazine. A bar extends between a front end and a rear end of the inner rail. A pusher bearing slidably receives the bar. A spring biases the pusher bearing toward the front end. A pusher block is coupled to the pusher bearing. The pusher block is moveable along the inner rail and is operable to urge the one or more fasteners toward the front end. The pusher block is moveable about the pusher bearing.

Further areas of applicability will become apparent from the description provided herein. It should be understood that the description and specific examples are intended for purposes of illustration only and are not intended to limit the scope of the present teachings.

BRIEF DESCRIPTION OF THE DRAWINGS

The drawings described herein are for illustration purposes only and are not intended to limit the scope of the present teachings in any way.

DETAILED DESCRIPTION

Figure 1:
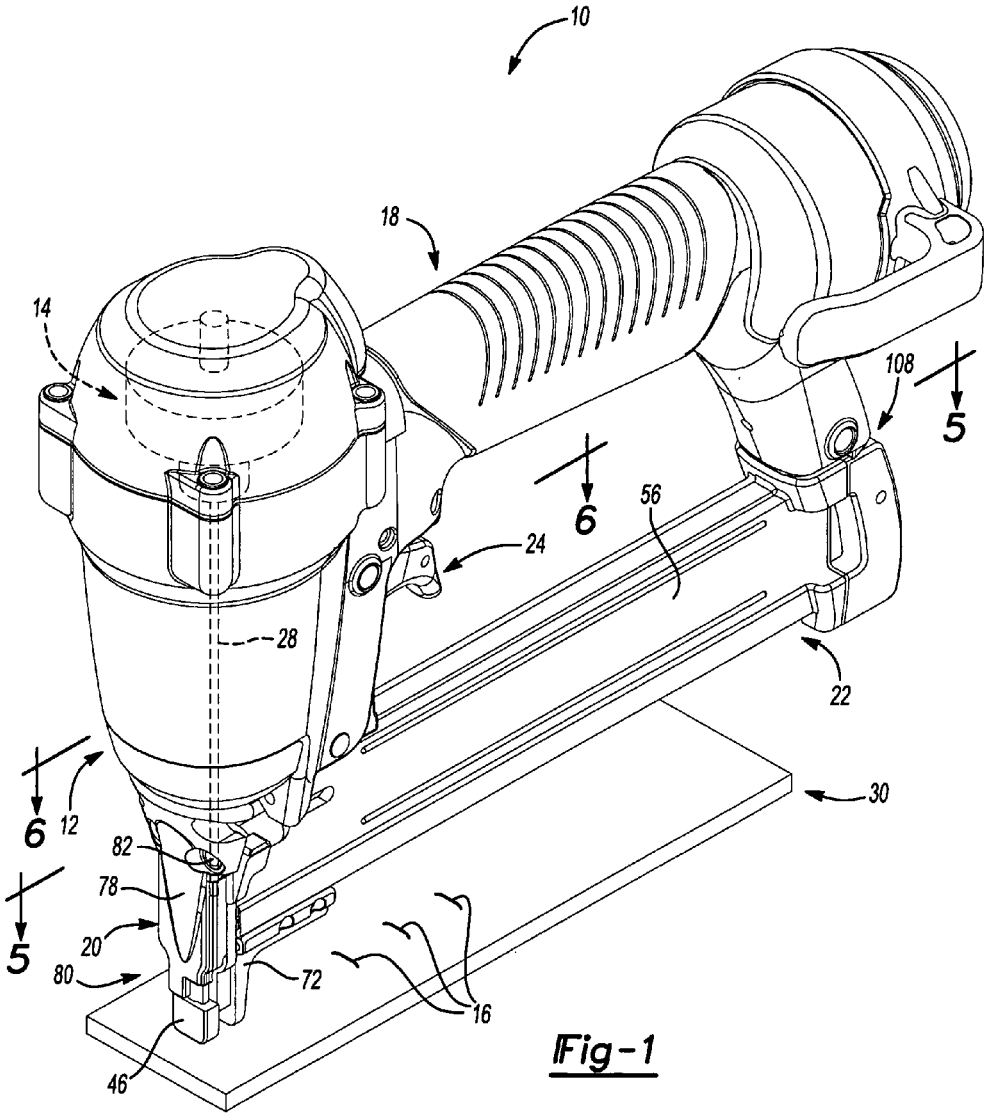
FIG. 1 is a perspective view of a fastening tool constructed in accordance with the present teachings showing a nosepiece and a magazine in a closed position. The nosepiece is shown against a workpiece that places a contact trip mechanism in a retracted condition.

The following description is merely exemplary in nature and is not intended to limit the present teachings, their application or uses. It should be understood that throughout the drawings corresponding reference numerals can indicate like or corresponding parts and features.

Figure 2:
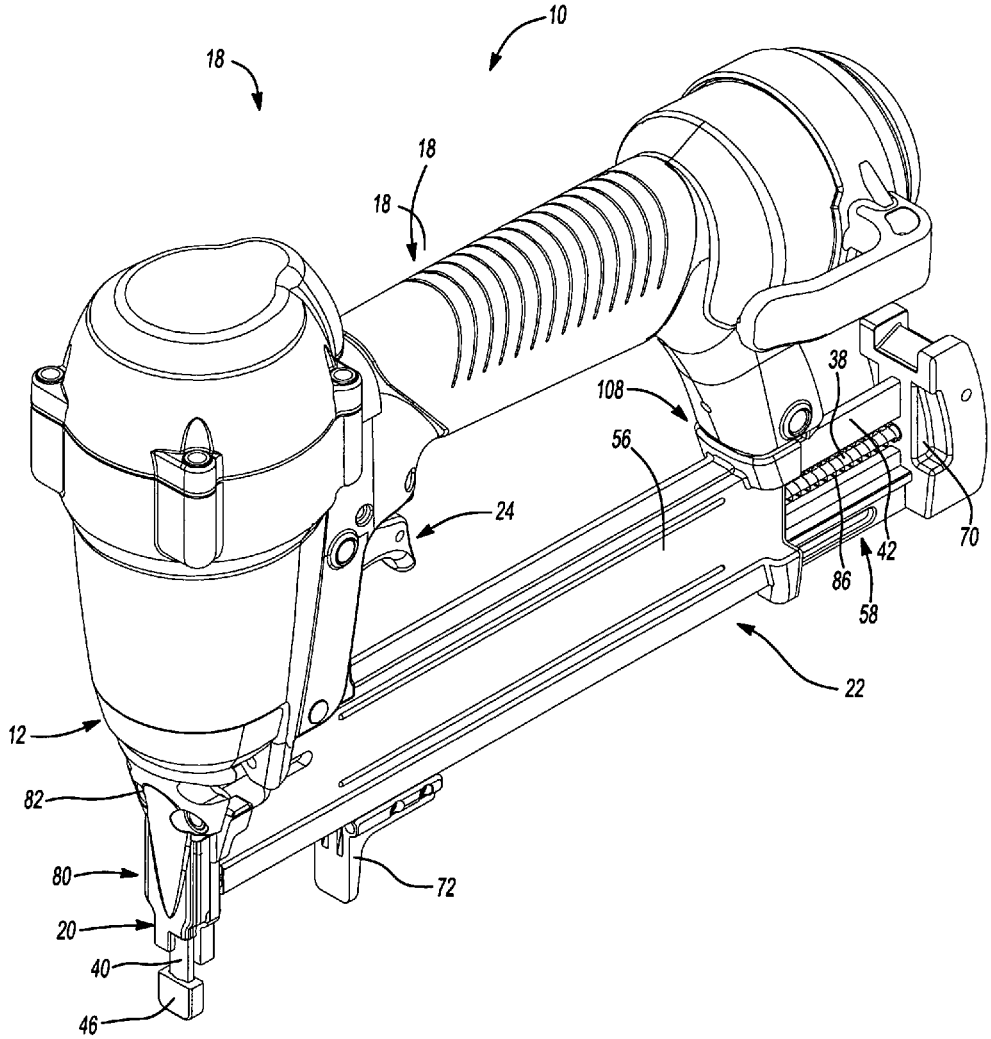
FIG. 2 is similar to FIG. 1 and shows the magazine in an open position and shows the nosepiece not engaged. With a tip of the nosepiece not engaged, the contact trip mechanism is in an extended condition and the fastening tool cannot be activated by a trigger assembly.

With reference to FIGS. 1 and 2, the present teachings generally include a fastening tool 10 having a main housing 12 that can contain a driving mechanism 14 for driving one or more fasteners 16, such as a nail or a staple. The fastening tool 10 can include a handle 18, a nosepiece 20 that can be disposed below the main housing 12 and a magazine 22 that can be connected to the nosepiece 20 and the handle 18. A trigger assembly 24 can be disposed on the main housing 12 and/or the handle 18 for activating the driving mechanism 14, as is known in the art. The driving mechanism 14 can include, for example, pneumatic-based systems such as those shown in commonly assigned U.S. Pat. Nos. 3,673,922 or 5,181,450, or an electrical system such as those shown in U.S. Pat. No. 4,928,868. The above references are hereby incorporated by reference in their entirety as if fully set forth herein.

Figure 5:
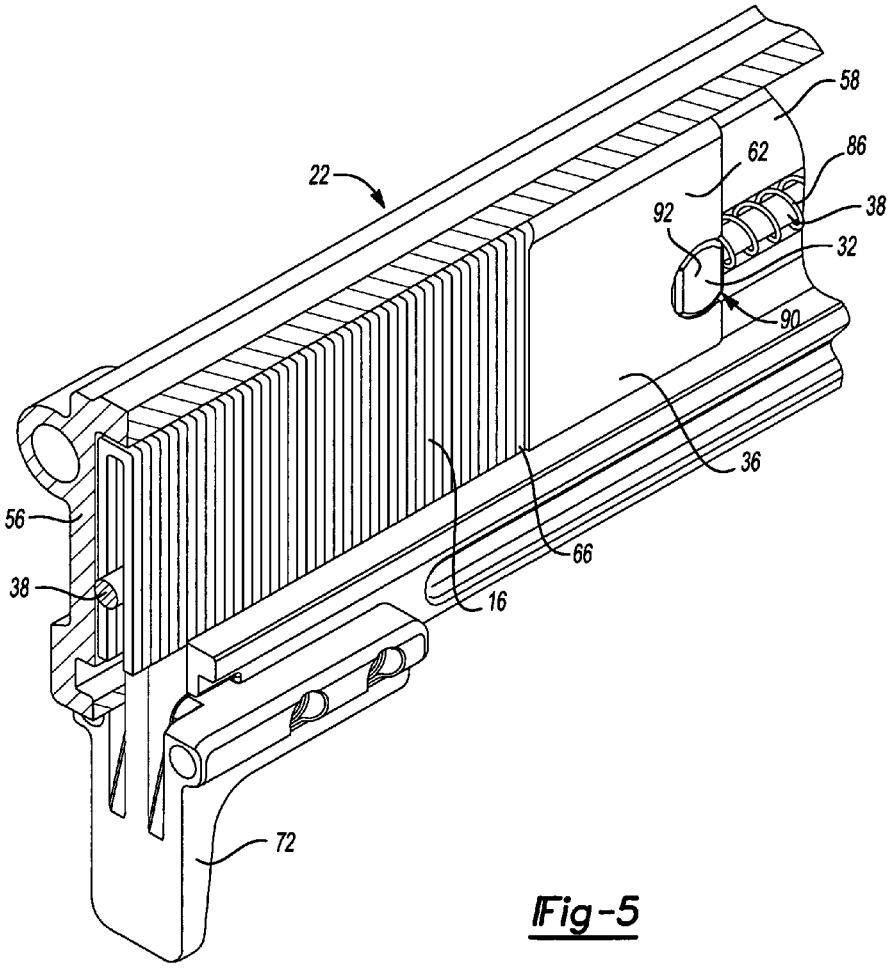
FIG. 5 is a partial cross-sectional view of FIG. 1 showing the pusher bearing, the pusher block and the fasteners in the magazine having the outer case illustrated as cut-away.
Figure 6:
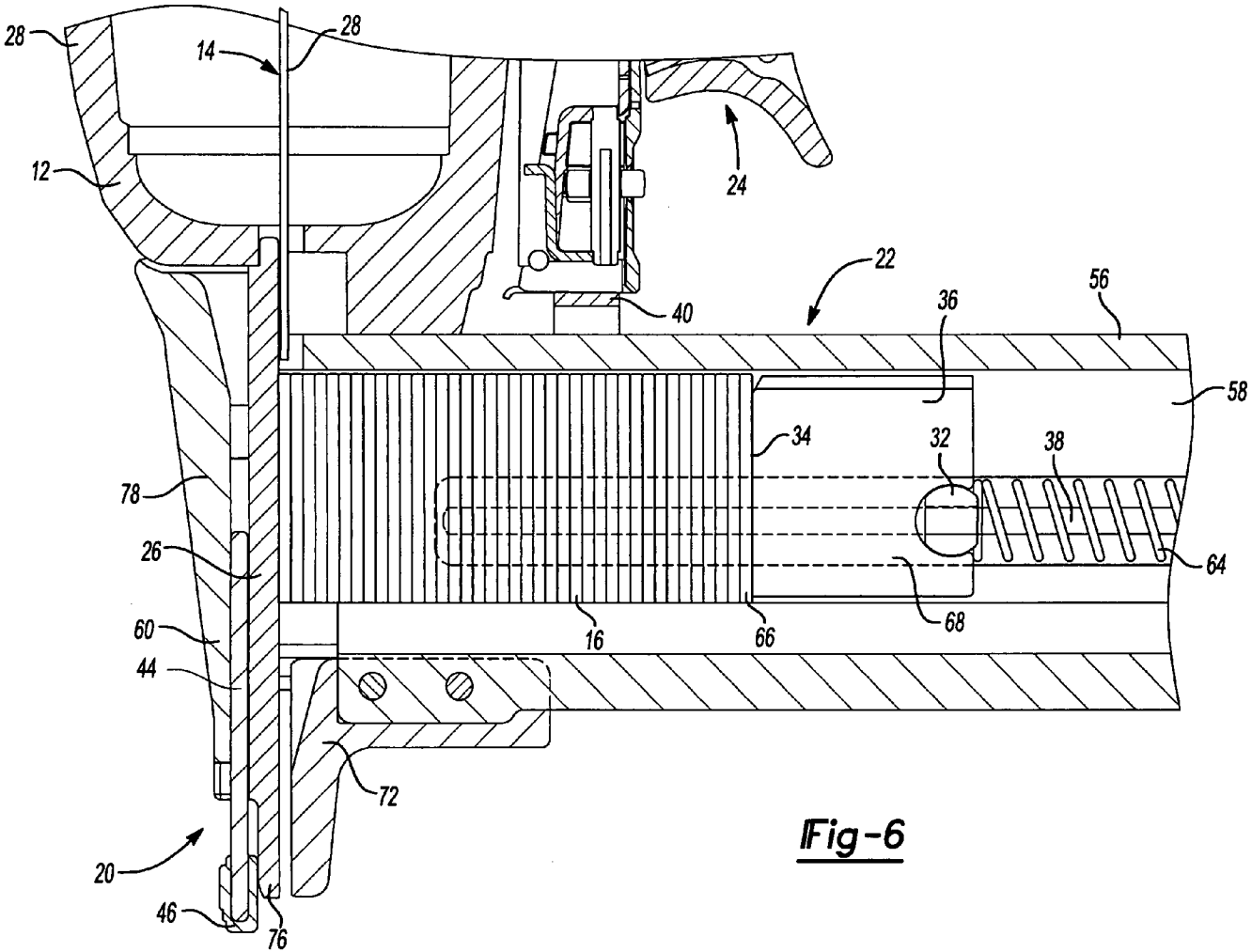
FIG. 6 is a different partial cross-sectional view of FIG. 1 showing a driver blade channel formed by an outer nose member and an inner nose member of the nosepiece. The inner nose is connected to the magazine, which is in the closed position.

With reference to FIGS. 5 and 6, the magazine 22 can contain the fasteners 16 and can sequentially feed the fasteners 16 into a driver blade channel 26. Once the fasteners 16 are aligned in the driver blade channel 26, a driver blade 28 can be extended from a retracted condition (FIG. 1) to drive one of the fasteners 16 out of the driver blade channel 26 and into a workpiece 30 (FIG. 1). The driver blade 28 can extend from the retracted condition to an extended condition, when the driving mechanism 14 is activated via the trigger assembly 24, as is known in the art.

Figure 4:
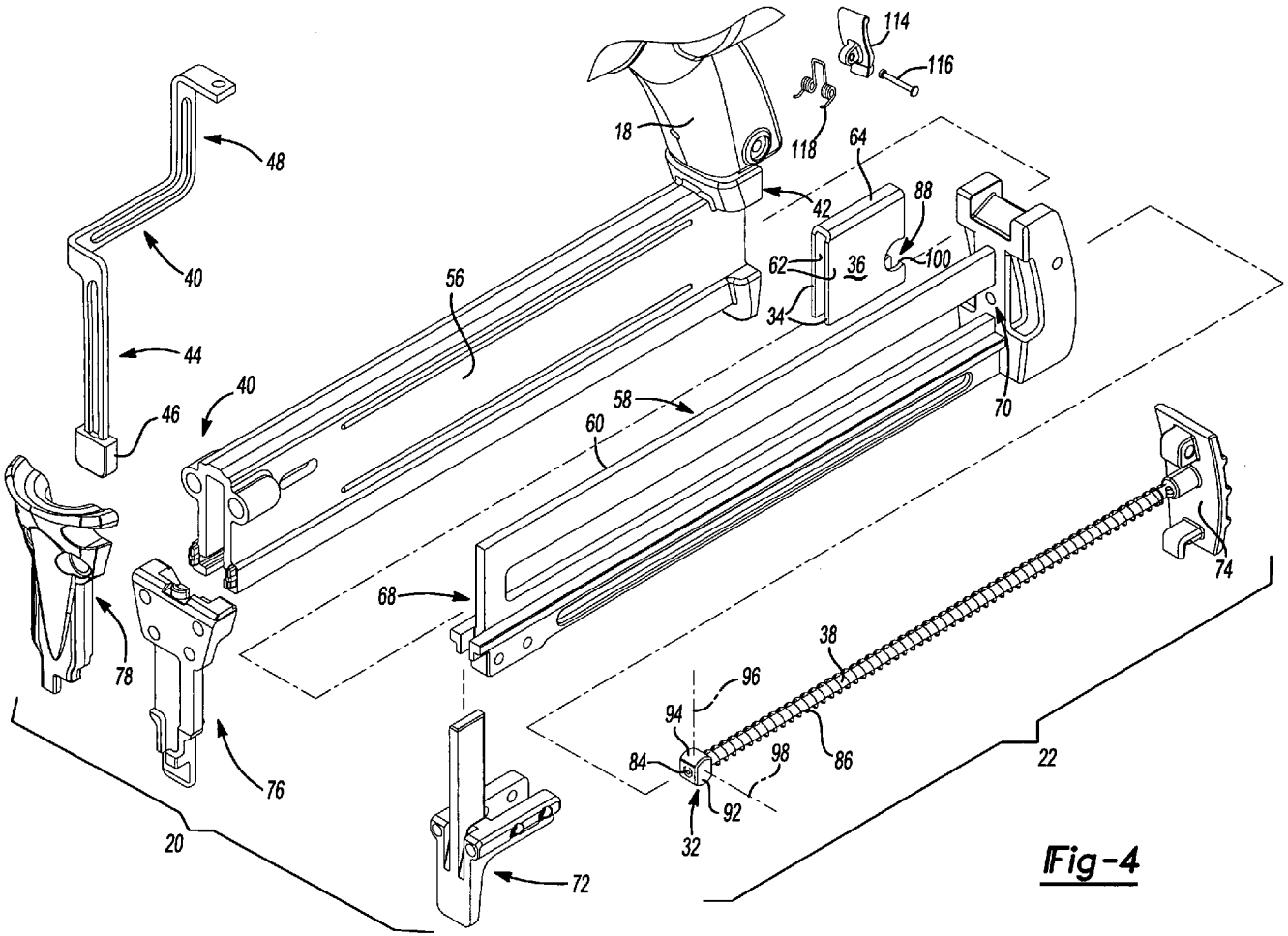
FIG. 4 is an exploded assembly view of the magazine of FIG. 1 showing an outer case, an inner rail, a pusher block and a pusher bearing.
Figure 7:
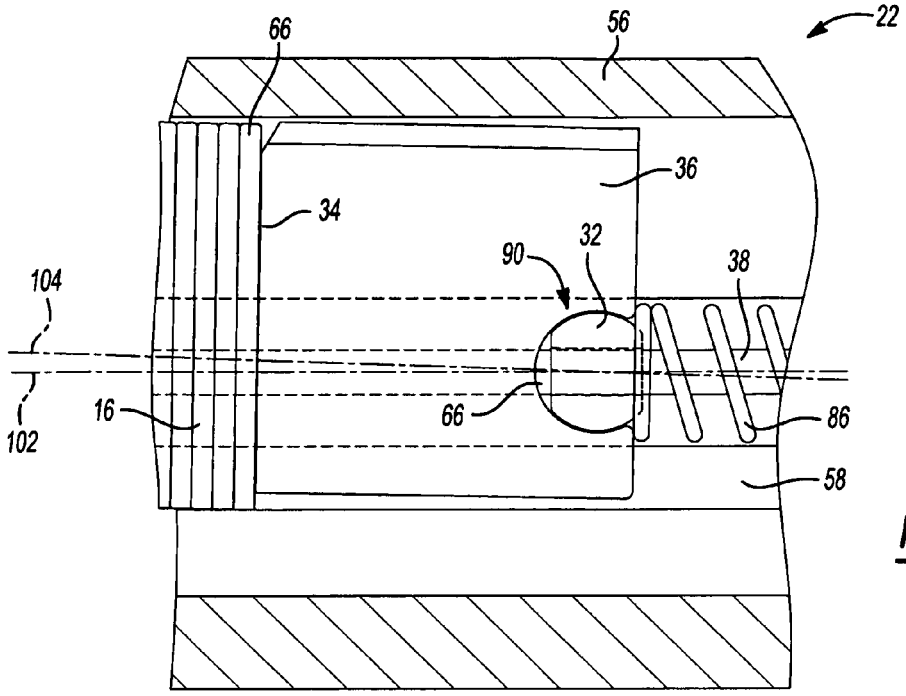
FIG. 7 is a diagram showing a pushing surface of the pusher block abutting a last fastener in a slightly upward direction because the pusher block is able to rock about the pusher bearing constructed in accordance with the present teachings.
Figure 8:
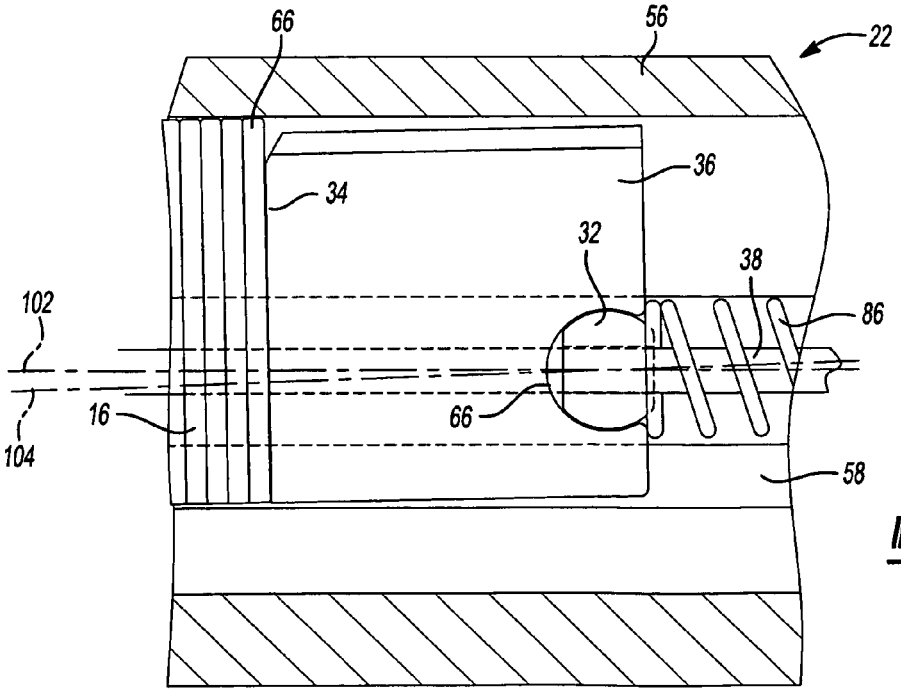
FIG. 8 is similar to FIG. 7 and shows the pusher block in a slightly downward direction relative the pusher bearing constructed in accordance with the present teachings.

With reference to FIGS. 4, 7 and 8, the magazine 22 can include a pusher bearing 32 that urges a pusher surface 34 on a pusher block 36 against the fasteners 16 to urge the fasteners 16 toward the nosepiece 20. Because the pusher block 36 can move relative to the pusher bearing 32, it can be shown that the pusher block 36 can provide relatively more uniform pressure against the fasteners 16 as the pusher block 36 urges the fasteners 16 toward the nosepiece 20. Because the pusher block 36 can move or rock about the pusher bearing 32, the pusher surface 34 of the pusher block 36 can be disposed at a non-parallel orientation relative the pusher bearing 32 and a pusher rod or bar 38 on which the pusher bearing 32 slides. Because the pusher surface 34 can abut the fasteners 16 in an orientation that is not parallel to a force exerted against the pusher block 36, it can be shown that the propensity for the fasteners 16 to jam in the magazine 22 can be reduced relative to a pusher block (not shown) that is slidable within the magazine but which is otherwise not moveable or able to rock about a pusher rod or other suitable portions of the magazine 22.

Figure 3:
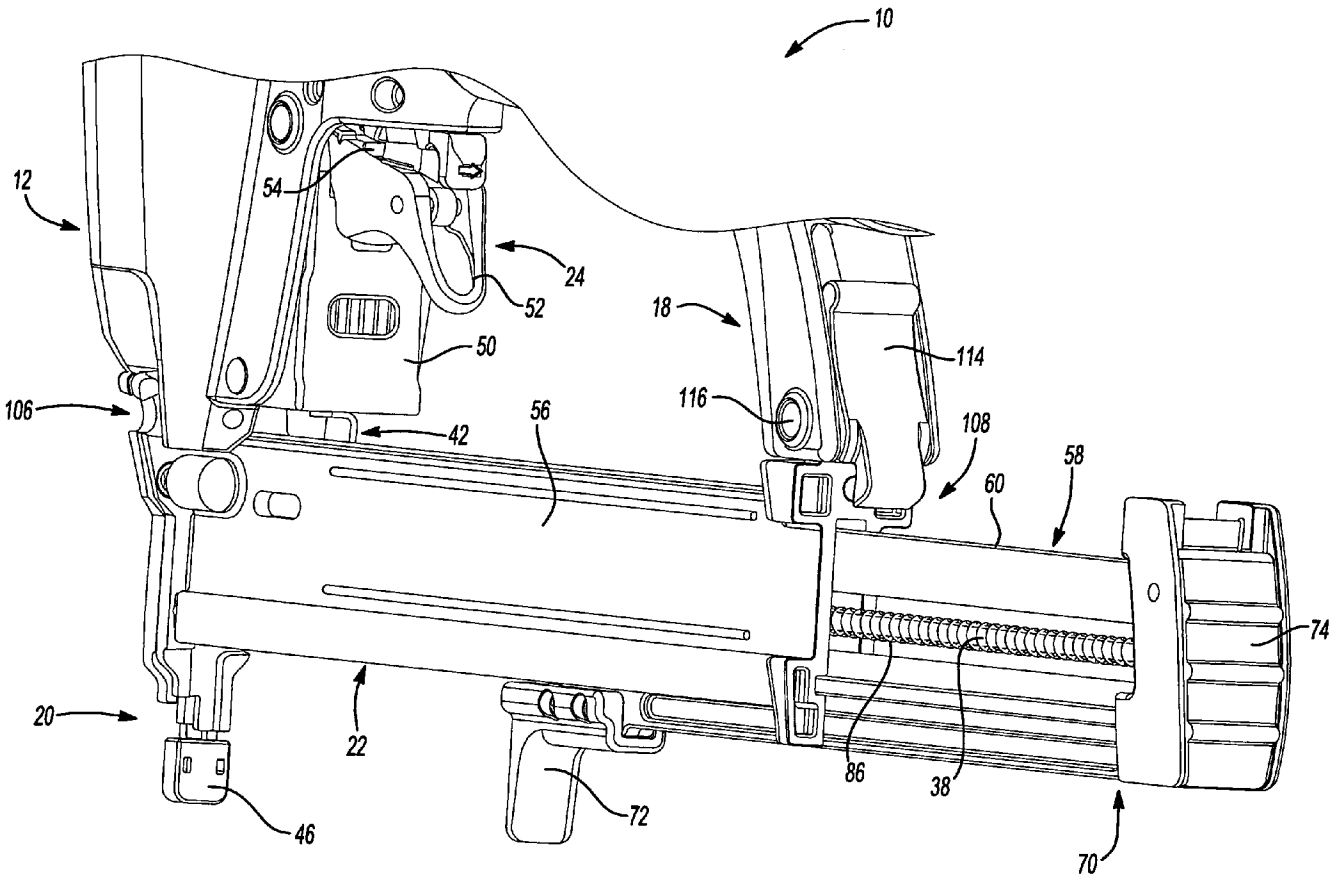
FIG. 3 is similar to FIG. 2 and shows the trigger assembly, a depth adjustment mechanism and a magazine clip.

With reference to FIGS. 3, 4 and 6, the contact trip mechanism 42 can include a lower member 40. The lower member 40 can have a first portion 44 that is associated with the nosepiece 20 and can be coupled to a tip 46 that can contact the workpiece 30 (FIG. 1). A second portion 48 of the lower member 40 can be coupled to a depth adjustment mechanism 50 disposed beneath the trigger assembly 24. When the tip 46 is pressed against the workpiece 30, as shown in FIG. 1, the contact trip mechanism 42 can move from an extended condition to a retracted condition. When the contact trip mechanism 42 is positioned in the retracted condition, the contract trip mechanism 42 can permit the driving mechanism 14 of the fastening tool 10 to be activated via the trigger assembly 24, as is known in the art. When the contact trip mechanism 42 is positioned in the extended condition, the fastening tool 10 cannot be activated.

The trigger assembly 24 can have a main trigger 52 that can be pivotally attached to the main housing 12 or the handle 18 and a supplemental trigger 54 that can be pivotally attached to the main trigger 52. When the main trigger 52 and the contact trip mechanism 42 are activated (i.e., the lower member 40, the tip 46, etc. move to the retracted condition), the supplemental trigger 54 can move a valve or a switch to activate the driving mechanism 14. It will be appreciated that the supplemental trigger 54 can move a switch when the driving mechanism 14 is an electric system or an airflow control valve when the driving mechanism 14 is a pneumatic system. Operation of the trigger assembly in combination with the contact trip assembly is well known in the art and is described in, for example, commonly assigned U.S. Pat. No. 5,785,228, which is incorporated by reference in its entirety as if fully set forth herein.

With reference to FIGS. 3 and 5, the magazine 22 includes an outer case 56 in which an inner rail 58 can slide from an open position (FIG. 3) to a closed position (FIG. 1). In the open position, one or more of the fasteners 16 can be added to the magazine 22, albeit in a position where the inner rail 58 is moved farther away from the nosepiece 20 than what is illustrated in FIG. 3. The inner rail 58 can then be closed, i.e., moved to the closed position, as shown in FIG. 1, to urge the fasteners 16 against the nosepiece 20 and thus align one of the fasteners 16 in the driver blade channel 26, as shown in FIG. 6.

The pusher block 36 can be in an upside down U-shaped configuration and ride over a top member 60 of the inner rail 58. In this regard, the pusher surface 34 can be defined by a pair of walls 62 connected by a top portion 64 of the pusher block 36. The pusher surface 34 can be disposed to generally match the orientation of the fasteners 16, e.g., a surface of one staple 66 (i.e., the last staple) abuts the pusher surface 34 where the staple 66 and the pusher surface 34 are ideally parallel, as shown in FIGS. 7 and 8.

The pusher block 36 can be made of acetal, which can be also be known as polyacetal, polyoxymethylene or polyformaldehyde. Other suitably performing polymers can also be used to form the pusher block 36. For example, the pusher block can be made of Delrin® readily available from DuPont or Celcon® readily available from Ticona (Florence, Ky.).

When the pusher block 36 is made of acetal or other suitable material, the pusher block 36 has a coefficient of friction that can be less than or equal to the coefficient of friction of the inner rail 58 and/or the outer case 56 on and/or in which the pusher block 36 slides. The inner rail 58 and the outer case 56 can be made of aluminum or other suitable metals or plastics. The ability of the pusher block 36 to more easily slide along the inner rail 58 can reduce the propensity of the fasteners 16 jamming in the magazine 22.

The inner rail 58 can include a front end 68 and a rear end 70. The pusher rod or bar 38 can be disposed between the front end 68 and the rear end 70. An inner nose member 72 associated with the nosepiece 20 can connect to the front end 68, while a magazine bumper 74 can connect to the rear end 70.

When the inner rail 58 is moved to the closed position (FIG. 1), the inner nose member 72 approaches an outer nose member 76, also of the nosepiece 20, but can remain spaced from the outer nose member 76. The spacing between the outer nose member 76 and the inner nose member 72 can be sufficient to define the driver blade channel 26, (i.e. the channel through which one of fasteners 16 travels as it is driven into the workpiece 30). Moreover, the fasteners 16 can be urged against a surface of the outer nose member 76 that can face the driver blade channel 26 and thus align one of the fasteners 16 in the driver blade channel 26, as shown in FIG. 5.

A nose cover 78 can connect to the outer nose member 76 to form a front face 80 of the nosepiece 20. The nose cover 78 can, moreover, hold heads 82 of fasteners that can couple the nosepiece 20 to the magazine 22.

The pusher bearing 32 can be formed with a through hole 84 that slidably receives the pusher rod 38. In addition, a spring 86 can be disposed over the pusher rod 38 such that the pusher rod 38 is threaded through the spring 86. The spring 86 can be coupled to the pusher bearing 32 to bias the pusher bearing 32 towards the nosepiece 20. The pusher bearing 32 can, in turn, be coupled to the pusher block 36.

The pusher block 36 can define a pair of rounded apertures 88 formed in each of the walls 62 that can be configured to receive the pusher bearing 32. The pusher bearing 32 can also have a rounded or semi-cylindrical configuration (FIG. 4) that can be received in the apertures 88 of the walls 62 of the pusher block 36. In this regard, a ball and socket joint 90 can be formed between the pusher bearing 32 and the pusher block 36. The rounded configuration of the pusher block apertures 88 and the pusher bearing 32 can permit the pusher block 36 to move (i.e., pivot) relative to the pusher bearing 32 as the pusher bearing 32 urges the pusher block 36, and the fasteners 16, toward the nosepiece 20.

The pusher bearing 32 can have walls 92 that can be generally parallel to one another. The pusher bearing 32 can also have a generally cylindrical surface 94 that can be bounded by the walls 92. An imaginary line 96 can extend in a direction generally normal to the cylindrical surface 94. The imaginary line 96 can also be generally perpendicular to an imaginary line 98 that can extend from one the walls 92. The walls 62 of the pusher block can be generally flush with the walls 92 of the pusher bearing 32. As such, the pusher block apertures 88 can have an arcuate surface 100 that can receive the cylindrical surface 94 of the pusher bearing 32. The pusher block 36, therefore, can be operable to move or rock relative to or about the pusher bearing 32, as the pusher bearing 32 urges the pusher block 36, and the fasteners 16, toward the nosepiece 20.

For example and with reference to FIGS. 7 and 8, a force applied by the spring 86 in a first direction 102 can be, in turn, applied by the pusher surface 34 to the staple 66 in a second direction 104. The first direction 102 and the second direction 104, in some instances, are not parallel and the second direction 104 need not be parallel to the pusher rod 38. Since the pusher block 36 is able to move about the pusher bearing 32, the pressure applied to the fasteners 16 by the pusher block 36 can be more uniform as compared to a pusher block that is rigidly attached to a pusher bearing or other suitable portion of a magazine.

With reference to FIG. 3, the magazine 22 can be coupled to the main housing 12 and/or the handle 18 at a first connection point 106 and a second connection point 108. The first connection point 106 can be adjacent to the nosepiece 20 such that a front end 110 of the magazine 22 can be coupled to the nosepiece 20 to form the driver blade channel 26 therebetween. At the second connection point 108, the magazine 22 connects to a rear end 112 of the handle 18.

At the second connection point 108, the housing 12 can include a magazine clip 114. The magazine clip 114 (FIG. 4) can pivot on a pin 116 that is coupled to the handle 18. Moreover, a spring 118 can bias the magazine clip 114 in a locked position, as shown in FIG. 1. By pressing the magazine clip 114 toward the housing 12 and against the bias of the spring 118, the magazine clip 114 can be moved from the locked position to an unlocked position. With the magazine clip 114 in the unlocked position, the inner rail 58 can be extracted from the outer case 56 of the magazine 22 and pulled away from the nosepiece 20, as shown in FIG. 3. By pulling the inner rail 58 out and away from the nosepiece 20, the fasteners 16 can be added to the magazine 22 to replenish the fasteners 16 in the magazine 22.

When fasteners 16 are added to the magazine 22, the inner rail 58 can be returned to the closed position, as shown in FIG. 1. The magazine bumper 74 that can be connected to the inner rail 58, can engage the magazine clip 114 to hold the magazine 22 in the closed position, as also shown in FIG. 1.

With reference to FIGS. 6, 7 and 8, when one or more fasteners 16 are contained within the magazine 22, the pusher block 36 will necessarily butt up against the last fastener (e.g. the staple 66) contained in the magazine 22 opposite the nosepiece 20. The spring 86 over the pusher rod 38 will be compressed between the pusher bearing 32 and the magazine bumper 74 (FIG. 3) and thereby bias pusher bearing 32 in a first direction toward nosepiece 20. The force exerted on the pusher block 36 is transferred to the fasteners 16 thus urging the fasteners 16 toward the nosepiece 20 to dispense the fasteners 16 into the driver blade channel 26. Because the pusher block 36 can move about the pusher bearing 32, the pusher surface 34 can apply pressure to the fasteners 16 in a second direction 104 that is not parallel to the first direction 102. Moreover, the pusher block 36 can rock about the pusher bearing 32 such that the second direction 104 can form an acute angle with the first direction upwardly and/or downwardly relative to the examples illustrated in FIGS. 7 and 8.

While specific aspects have been described in this specification and illustrated in the drawings, it will be understood by those skilled in the art that various changes can be made and equivalents can be substituted for elements thereof without departing from the scope of the present teachings, as defined in the claims. Furthermore, the mixing and matching of features, elements and/or functions between various aspects of the present teachings may be expressly contemplated herein so that one skilled in the art will appreciate from the present teachings that features, elements and/or functions of one aspect of the present teachings may be incorporated into another aspect, as appropriate, unless described otherwise above. Moreover, many modifications may be made to adapt a particular situation, configuration or material to the present teachings without departing from the essential scope thereof. Therefore, it may intended that the present teachings not be limited to the particular aspects illustrated by the drawings and described in the specification as the best mode presently contemplated for carrying out the present teachings but that the scope of the present teachings will include many aspects and examples following within the foregoing description and the appended claims.

What is claimed is:

1. A magazine for a fastening tool that drives one or more fasteners into a workpiece, the magazine comprising:

an outer case and an inner rail movable relative to said outer case, said inner rail extendable from said outer case so as to permit adding of the one or more fasteners to the magazine;

a bar that extends between a front end and a rear end of said inner rail;

a pusher bearing that slidably receives said bar;

a spring that biases said pusher bearing toward said front end; and a pusher block coupled to said pusher bearing, said pusher block moveable along said inner rail and operable to urge the one or more fasteners toward said front end, wherein said pusher block is moveable about said pusher bearing.

2. The magazine of claim 1 wherein said pusher block is made of a polymer having a coefficient of friction that is less than a coefficient of friction of said inner rail and said outer case.

3. The magazine of claim 1 wherein said pusher bearing and said pusher block form a ball and socket joint.

4. The magazine of claim 1 wherein said pusher block is capable of exerting a force on the one or more fasteners in a direction not parallel to said bar.

5. The magazine of claim 1 wherein said pusher block is generally u-shaped and disposed upside down over said inner rail.

6. The magazine of claim 1 further comprising an inner nose member that extends from said front end of said inner rail, said inner nose member and an outer nose member of a nosepiece define a driver blade channel therebetween.

7. The magazine of claim 1 wherein said pusher bearing includes two walls generally parallel to one another and a generally cylindrical surface bounded by said two walls, wherein an imaginary line extending in a direction normal to said cylindrical surface is generally perpendicular to an imaginary line extended from one of said two walls.

8. The magazine of claim 7 wherein said pusher block includes a pair of walls generally flush with said two walls of said pusher bearing.

9. The magazine of claim 7 wherein said pusher block includes a pair of walls and a generally arcuate aperture is formed in each of said walls such that said generally arcuate apertures receive said cylindrical surface of said pusher bearing.

* * * * *